US011932289B2

(12) United States Patent
Vachon

(10) Patent No.: US 11,932,289 B2
(45) Date of Patent: Mar. 19, 2024

(54) EXTERNAL SLIDING THRESHOLD ASSEMBLY FOR VEHICLE DOORS

(71) Applicant: Westinghouse Air Brake Technologies Corporation, Pittsburgh, PA (US)

(72) Inventor: Luc Vachon, Verdun (CA)

(73) Assignee: WESTINGHOUSE AIR BRAKE TECHNOLOGIES CORPORATION, Pittsburgh, PA (US)

( * ) Notice: Subject to any disclaimer, the term of this patent is extended or adjusted under 35 U.S.C. 154(b) by 197 days.

(21) Appl. No.: 17/511,318

(22) Filed: Oct. 26, 2021

(65) Prior Publication Data

US 2022/0274473 A1 Sep. 1, 2022

Related U.S. Application Data

(60) Provisional application No. 63/154,526, filed on Feb. 26, 2021.

(51) Int. Cl.

| | |
|---|---|
| ***B61D 23/00*** | (2006.01) |
| ***B61D 19/02*** | (2006.01) |
| ***B61D 23/02*** | (2006.01) |

(52) U.S. Cl.

CPC ..... *B61D 23/00* (2013.01); *B61D 19/02* (2013.01); *B61D 23/025* (2013.01)

(58) Field of Classification Search

CPC ..... B61D 23/02; B61D 19/009; B61D 23/00; B61D 19/02; B61D 23/025; E05F 15/655

See application file for complete search history.

(56) References Cited

U.S. PATENT DOCUMENTS

| | | | | |
|---|---|---|---|---|
| 3,788,007 | A * | 1/1974 | Bailey | B61D 19/001 292/254 |
| 5,070,794 | A * | 12/1991 | Kunst | B61D 19/02 280/166 |
| 6,263,804 | B1 * | 7/2001 | Rizk | B61D 23/02 105/430 |
| 6,357,362 | B1 * | 3/2002 | Krbec | B61D 23/02 105/426 |
| 6,443,072 | B2 | 9/2002 | Rizk | |
| 6,591,760 | B2 * | 7/2003 | Brunooghe | B61D 23/02 105/437 |
| 7,784,406 | B2 | 8/2010 | Chisena | |
| 7,913,628 | B2 | 3/2011 | Chisena | |

(Continued)

OTHER PUBLICATIONS

GPO, § 38.93 49 CFR Subtitle A (Oct. 1, 2004 Edition) (p. 584).

(Continued)

*Primary Examiner* — Scott A Browne

(74) *Attorney, Agent, or Firm* — The Small Patent Law Group LLC; Christopher R. Carroll

(57) ABSTRACT

A threshold assembly for a vehicle door includes an external sliding threshold configured to be coupled with an exterior surface of a vehicle having a doorway. The external sliding threshold is configured to extend over the doorway to provide a threshold surface on which one or more passengers enter the vehicle via the doorway or exit the vehicle via the doorway. The external sliding threshold laterally projects from the exterior surface of the vehicle to reduce or eliminate a spatial gap between the vehicle and a platform from which the one or more passengers enter the vehicle or onto which the one or more passengers exit the vehicle.

20 Claims, 7 Drawing Sheets

(56) References Cited

U.S. PATENT DOCUMENTS

| | | | | |
|---|---|---|---|---|
| 8,028,629 | B2 * | 10/2011 | Neugebauer | B61D 19/02 105/430 |
| 2001/0025585 | A1 * | 10/2001 | Rizk | B61D 23/02 105/430 |
| 2002/0078855 | A1 * | 6/2002 | Neugebauer | B61D 19/02 105/397 |
| 2008/0284202 | A1 * | 11/2008 | Filipczak | B60J 5/0418 296/146.1 |
| 2020/0070853 | A1 | 3/2020 | Dagenais et al. | |
| 2020/0385031 | A1 | 12/2020 | Augé et al. | |
| 2021/0131151 | A1 | 5/2021 | Vachon et al. | |

OTHER PUBLICATIONS

GPO, § 38.53 49 CFR Subtitle A (Oct. 1, 2010 Edition) (p. 496).
GPO, § 38.73 49 CFR Subtitle A (Oct. 1, 2010 Edition) (p. 498).
GPO, Office of the Secretary of Transportation § 38.113 (pp. 521-522).

* cited by examiner

EXTERNAL SLIDING THRESHOLD ASSEMBLY FOR VEHICLE DOORS

CROSS-REFERENCE TO RELATED APPLICATIONS

This application claims priority to U.S. Provisional Application No. 63/154,526 (filed 26 Feb. 2021), the entire disclosure of which is incorporated herein by reference.

BACKGROUND

Technical Field

The subject matter described herein relates to thresholds of sliding vehicle doors.

Discussion of Art

Some vehicles have sliding doors through which passengers can board or alight from the vehicles. For example, some rail vehicles, such as rail transit vehicles, can have sliding doors that open and close to allow passengers to embark and disembark from the vehicles. These vehicles may stop near a platform to allow passengers to board onto or alight from the vehicles. Some platforms may be lower than others, and the vehicles can have convertible high/low boarding doorways that are re-configurable between a low boarding doorway (to allow passengers to board the vehicles while at lower platforms) and a high boarding doorway (to allow passengers to board the vehicles while at higher platforms).

But some of these convertible high/low boarding doorways leave undesirable gaps between the side of the vehicle and the platform edge. For example, while operating in the high boarding doorway state, there may be a spatial gap between the platform edge and the side of the vehicle that faces the platform edge that is larger than applicable regulations permit. This gap can present a safety risk to passengers boarding and disembarking from the vehicles.

BRIEF DESCRIPTION

In one embodiment, an assembly is provided that includes an external sliding threshold configured to be coupled with an exterior surface of a vehicle having a doorway. The external sliding threshold is configured to extend over the doorway to provide a threshold surface on which one or more passengers enter the vehicle via the doorway or exit the vehicle via the doorway. The external sliding threshold laterally projects from the exterior surface of the vehicle to reduce or eliminate a spatial gap between the vehicle and a platform from which the one or more passengers enter the vehicle or onto which the one or more passengers exit the vehicle.

In one embodiment, a vehicle includes a doorway through which one or more passengers board or alight the vehicle, and a threshold assembly coupled with the vehicle. The threshold assembly includes an internal threshold located across the doorway frame of the vehicle and an external threshold located outside the vehicle. The internal threshold is configured to move along an interior of the vehicle while the external threshold moves along an exterior wall of the vehicle to an extended position where the internal threshold and the external threshold extend across the doorway to provide a threshold surface on which the one or more passengers enter the vehicle via the doorway or exit the vehicle via the doorway.

In one embodiment, an assembly includes an external sliding threshold configured to be coupled with an exterior surface of a vehicle having a doorway, and a linear telescopic slide coupled with the exterior surface of the vehicle and with the external sliding threshold. The linear telescopic slide is configured to move the external sliding threshold from a retracted state where the external sliding threshold does not laterally extend across the doorway to an extended state where the external sliding threshold extends across the doorway. The external sliding threshold is configured to provide a threshold surface on which one or more passengers enter the vehicle via the doorway or exit the vehicle via the doorway in the extended state.

BRIEF DESCRIPTION OF THE DRAWINGS

The inventive subject matter may be understood from reading the following description of non-limiting embodiments, with reference to the attached drawings, wherein below.

DETAILED DESCRIPTION

Figure 1:
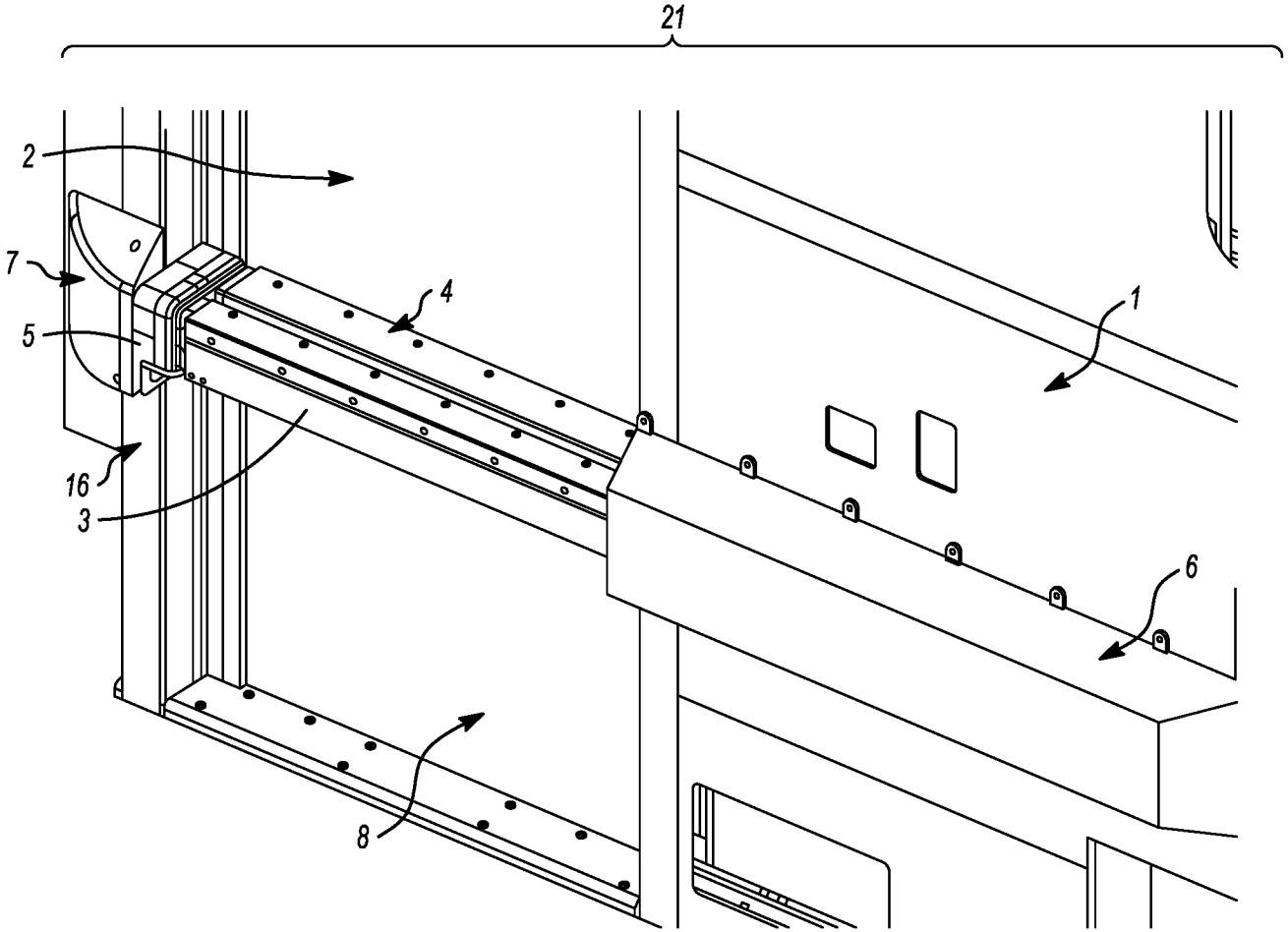
FIG. 1 illustrates one example of a vehicle doorway threshold assembly alongside an exterior wall of a vehicle having a convertible high/low boarding doorway.

Embodiments of the subject matter described herein relate to a vehicle doorway threshold assembly for a vehicle. The assembly can be used in connection with transit vehicles, such rail transit vehicles that move passengers between different locations. Alternatively, the assembly can be used with another type of vehicle having a doorway that is adaptable between a high platform state and a low platform state. The assembly can be coupled (e.g., bolted) on an outside wall of the vehicle, next to or otherwise near a reconfigurable high/low boarding doorway. This doorway can be large enough (e.g., tall enough) to allow passengers to board onto the vehicle and alight from the vehicle onto platforms that are farther from the route surface (e.g., higher platforms) and platforms that are closer to the route surface (e.g., lower platforms). In one example, the higher platforms may be disposed forty-eight inches (or one hundred twenty-two centimeters) above the route or surface on which the route is disposed. The lower platforms may be disposed eight inches (or twenty centimeters) above the route or surface on which the route is disposed. Alternatively, the platforms may be at other heights with higher platforms being farther from the ground or surface on which the route is disposed than the lower platforms.

The assembly can include an external sliding threshold that is coupled with an internal sliding threshold of the vehicle. As a result, deployment and retraction of the external sliding threshold can be driven by movement of the internal sliding threshold. The internal sliding threshold can provide an internal horizontal surface within the vehicle that passengers can step onto during boarding onto or alighting from the vehicle at higher platforms. The external sliding threshold can provide an external horizontal surface outside the vehicle that passengers can step onto during boarding onto or alighting from the vehicle at the higher platforms. The inventive assembly described herein can ensure that no large gap exists between the outer vehicle side surface and the edge of the platform that faces this surface. For example, the external sliding threshold can reduce or eliminate this gap so that any remaining gap is smaller than the applicable regulations existing as of the filing date of this application and eventual patent(s) issuing therefrom. The assembly can be retrofitted to existing installations of vehicles and/or can be included in the manufacture of new vehicles.

The assembly includes the external sliding threshold that outwardly extends from a threshold surface of an internal sliding threshold of a convertible high/low vehicle boarding doorway. The assembly can include a linear telescopic slide, an external sliding threshold, a locking block, and a coupling plate. The linear slide can be horizontally disposed on an outside wall of the vehicle adjacent to the vehicle doorway. The linear slide can be fastened to this outside wall of the vehicle. The linear slide can telescope outward to increase the length of the slide and can telescope inward to decrease the length of the slide. The external threshold is coupled with the linear slide such that the external threshold moves with the linear slide. For example, the external threshold may move to a position between the vehicle doorway and the platform when the linear slide telescopes outward to increase the length of the linear slide. The external threshold may move away from this position such that the external threshold is no longer between the doorway and the platform when the linear slide telescopes inward to reduce the length of the linear slide.

The locking block of the assembly can be fastened to a door post of the vehicle door. This door post can be opposite of the linear slide. The locking block latches or otherwise couples with the external sliding threshold, and can provide a surface for transferring at least some of the load of passengers stepping onto the external sliding threshold. For example, the locking block can transfer some or all of this load to the body of the vehicle. The locking block can include an external wedge section or portion that can be fastened to the outside of the vehicle next to the door post. This wedge section can transfer the passenger load (or at least part of the passenger load but less than all of the passenger load) to the body of the vehicle.

The coupling plate of the assembly mechanically joins the external sliding threshold with an internal sliding threshold. As a result, movement of the external sliding threshold is driven in the deployed and the retracted positions by motion of the internal sliding threshold that is transferred to the external sliding threshold. This allows for the assembly to be installed on the vehicle with minimal impact on the existing design and operation of a convertible high/low boarding doorway. The coupling of the external sliding threshold with the internal sliding threshold avoids the need for an additional drive system that moves the external sliding threshold. Additionally, the controls of the vehicle door may not need to be modified.

FIG. 1 illustrates one example of a vehicle doorway threshold assembly 21 alongside an exterior wall 1 of a vehicle having a convertible high/low boarding doorway 2. A door or door panel 8 of the vehicle is shown in the closed position in FIG. 1. An internal sliding threshold 4 is disposed across the doorway frame of the vehicle. As shown, the internal sliding threshold may be a horizontally oriented surface on which passengers may step while boarding and alighting from the vehicle via the doorway while the vehicle is parked or otherwise stopped at a higher platform. The internal sliding threshold is disposed between the door panel and an external sliding threshold 3.

In one embodiment of the inventive subject matter described herein, an external sliding threshold 3 is connected with the internal sliding threshold. The external sliding threshold extends the horizontal walking surface of the internal threshold by a width 15 (shown in FIG. 4). This width may typically vary between 3 to 5 inches (or 7.6 centimeters to 12.7 centimeters). The external sliding threshold moves with the internal sliding threshold. For example, the external sliding threshold may move with the internal sliding threshold to an extended position shown in FIG. 1 such that the external and internal sliding thresholds separate the doorway into upper and lower portions, with the lower portion below the higher passenger platform that is outside of the vehicle and the upper portion that is above the higher passenger platform.

A locking block 5 receives ends of both the internal sliding threshold and the external sliding threshold. This block includes a locking device such as the sliding door locking device described in U.S. patent application Ser. No. 17/085,435, filed 30 Oct. 2020, the entire disclosure of which is incorporated herein by reference. Alternatively, another lock can be used. The locking block receives the ends of the sliding thresholds to hold the sliding thresholds in the extended position shown in FIG. 1. The locking block is fastened to a door post 16. The door post defines the vertical left boundary or side of the doorway in the illustrated example. The internal and external sliding thresholds can move from a retracted position toward the right in the perspective of FIG. 1 to the extended position toward the left in the perspective of FIG. 1.

An external sliding threshold cover 6 may be disposed outside of the vehicle. This cover may be coupled with the external side or surface of the vehicle. The external sliding threshold may recede into this cover when the external sliding threshold is moved from the extended position shown in FIG. 1 to a retracted position shown in FIGS. 5 through 7. The cover can define a volume in which the external sliding threshold is entirely or partially disposed. This volume can be bounded by the cover and the external wall or surface of the vehicle. Alternatively, the cover can extend around and define the volume alone without the external wall or surface of the vehicle. The cover optionally can include one or more holes along a bottom side or wall of the cover. This can allow moisture within the cover to drain out of the cover.

Figure 2:
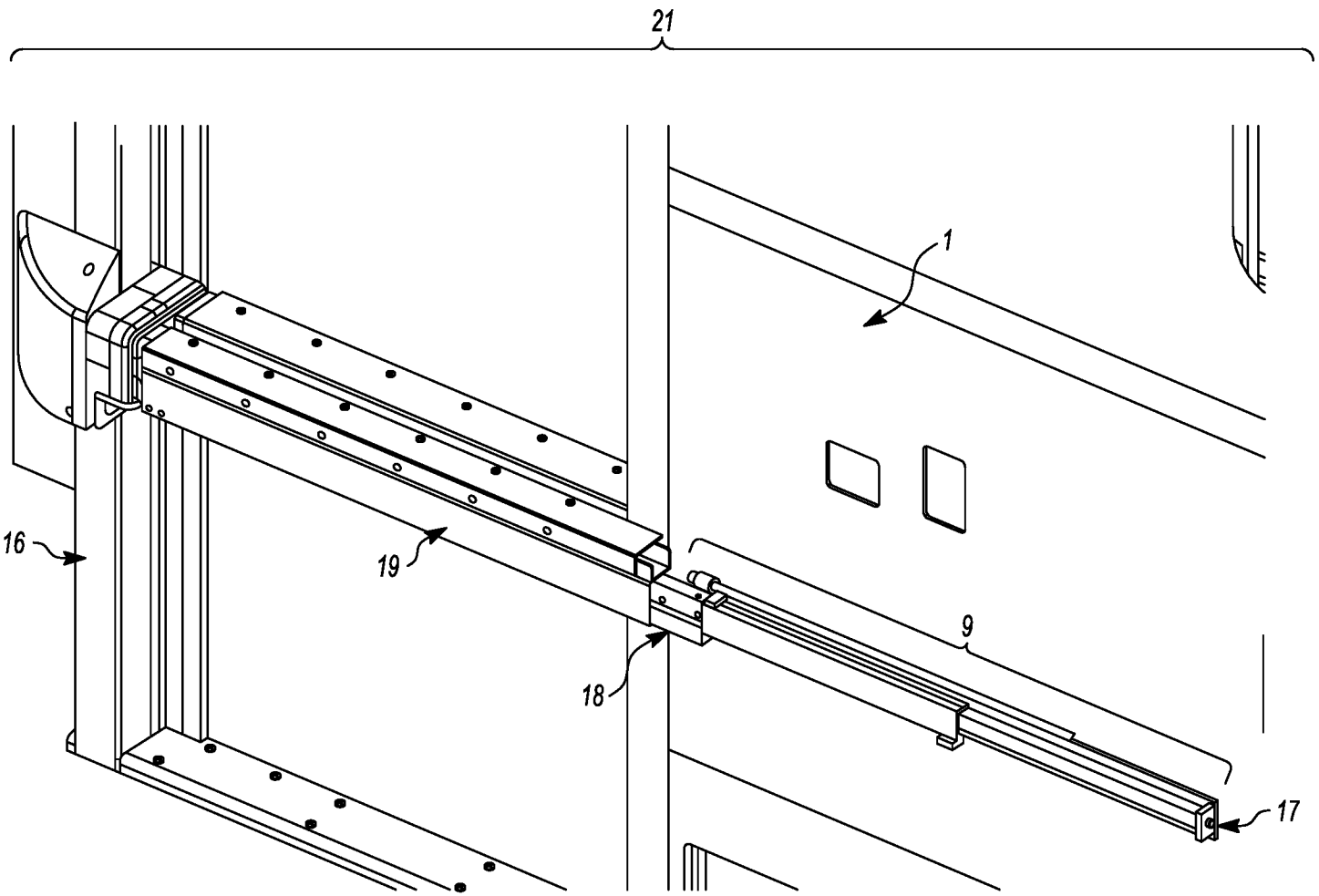
FIG. 2 illustrates the same high/low boarding doorway in the door closed state with the cover of the external sliding mechanism removed.

FIG. 2 illustrates the same high/low boarding doorway in the door closed state with the cover of the external sliding mechanism removed. The assembly includes a telescopic slide 9 having a first member 17 fastened to the exterior side wall of the vehicle. The telescopic slide also includes a second member 18 fastened to a mobile exterior threshold extension 19. One or more intermediate members of the telescopic slide may be present between the first member 17 and the second member 18. The second member (and the one or more intermediate members, if present) slide along the first member from the retracted position of the assembly to the illustrated extended position of the assembly. The telescopic slide can change length in this way to move between the extended and retracted positions. Coupling the telescopic slide to the external wall of the vehicle allows partial transmission of load and torque from the external sliding threshold to the car side wall.

Figure 3:
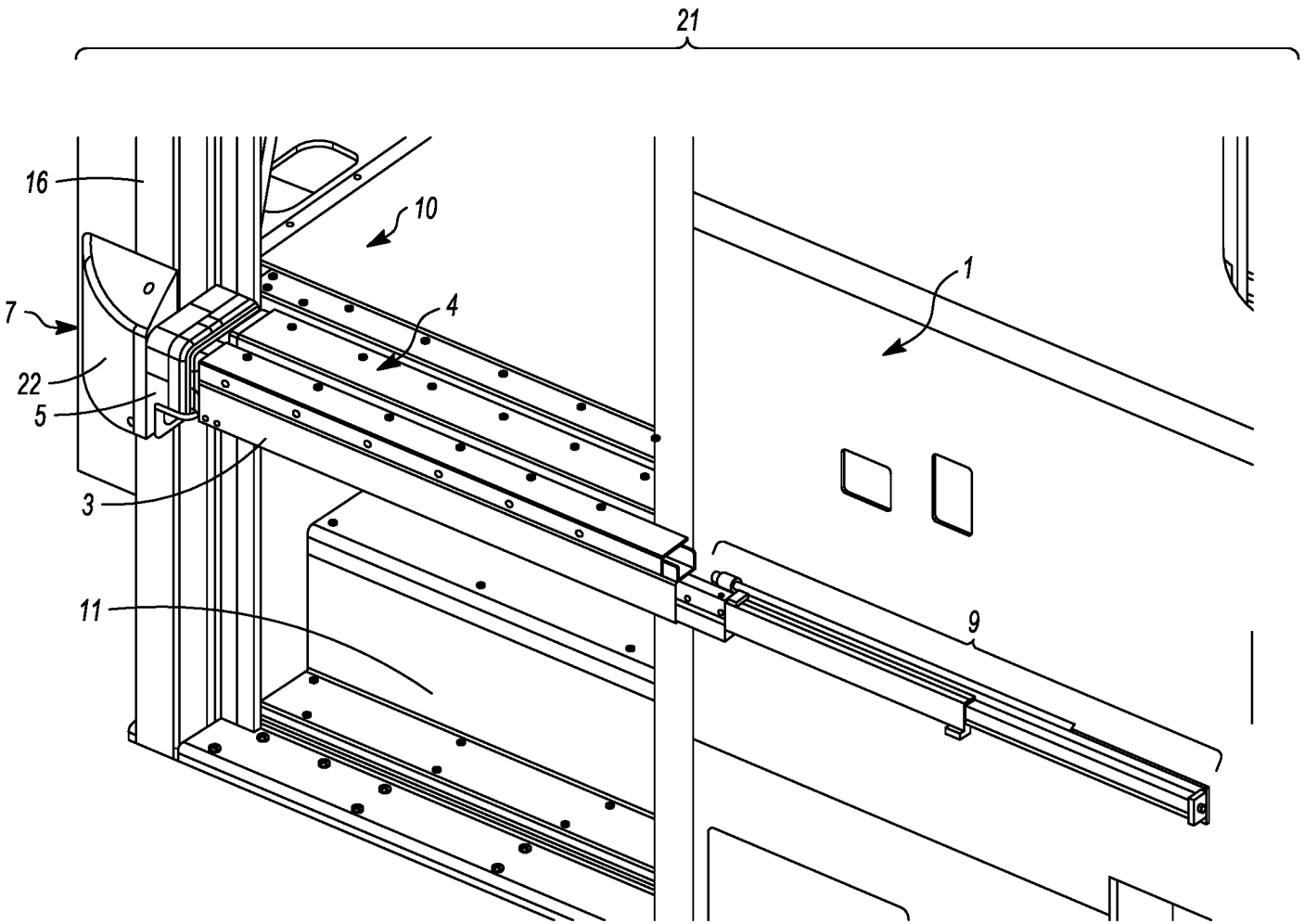
FIG. 3 illustrates the vehicle doorway threshold assembly with the door of the vehicle opened in a high boarding configuration.

FIG. 3 illustrates the vehicle doorway threshold assembly with the door of the vehicle opened in a high boarding configuration. In this configuration, the internal and external sliding thresholds are in the extended state such that these threshold extend across the doorway (e.g., extend from one lateral or vertical side of the doorway to the door post along the opposite lateral or vertical side of the doorway). A trap door 10 is disposed inside the vehicle and inwardly extends from the internal sliding threshold. The vehicle includes steps or stairs 11 inside the doorway to assist passengers in boarding the vehicle when the vehicle is at a lower platform. The trap door couples with the internal sliding threshold when the vehicle is at a higher platform to provide a raised surface above the lower stairs on which passengers board the vehicle from the higher platform. For example, the trap door may rest upon the internal sliding threshold and a step in the stairs (e.g., the top step or the upper surface to which the stairs lead to) to provide a horizontal surface for passengers to walk upon. The trap door also inhibits access to the lower steps of the stairs that are below the internal sliding threshold and the trap door.

Both the internal and external sliding thresholds can be latched to the locking block that is mounted to the door post. A wedge-shaped external support 7 of the locking block can be fastened to both the locking block and the door post. This arrangement allows for at least partial transmission of load and torque from the internal and external sliding thresholds to the door post. For example, some but not all of the load and/or torque applied to the thresholds may be transferred to the door post via the locking block and/or the external support.

The external support can have a front or leading surface 22 that is inclined or angled to the surface of the external wall of the vehicle (e.g., at an acute angle). This surface is located toward the leading end of the vehicle along a direction of travel of the vehicle. The orientation of this curved or angled surface can make the assembly more aerodynamic and safer (avoidance of sharp edge) when compared with the surface being perpendicularly oriented to the external surface of the vehicle.

Figure 4:
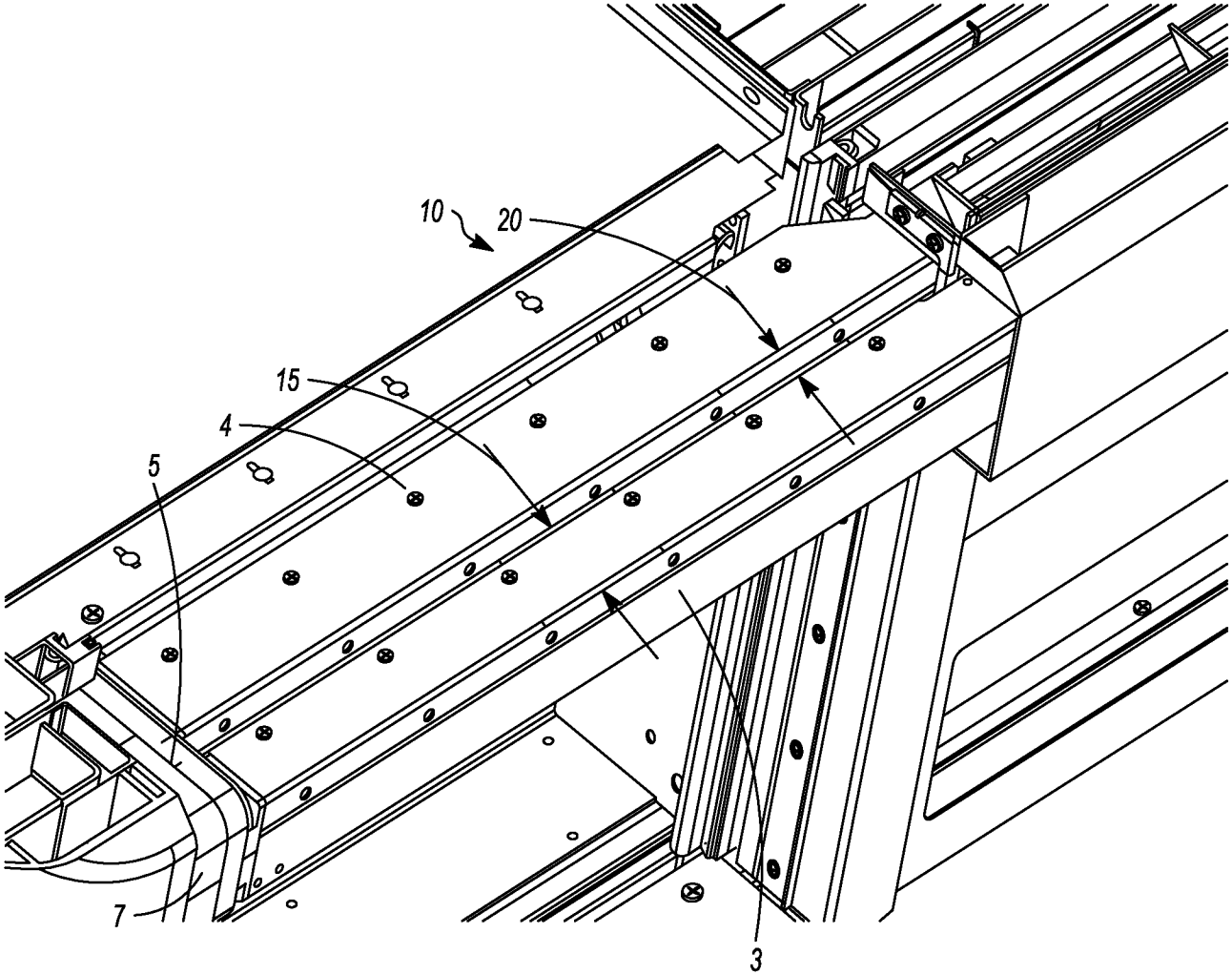
FIG. 4 illustrates the vehicle doorway threshold assembly with the vehicle door opened in high boarding configuration as shown in FIG. 3 but from another viewing angle.

FIG. 4 illustrates the vehicle doorway threshold assembly with the vehicle door opened in high boarding configuration as shown in FIG. 3 but from another viewing angle. A width dimension 15 of the external sliding threshold is shown in FIG. 4. This width dimension can reduce the size of a spatial gap between the vehicle and the platform from which passengers board the vehicle or onto which passengers exit the vehicle. For example, the external sliding threshold can laterally project from the side of the vehicle such that the gap between the vehicle and the platform is reduced due to the presence of the external sliding threshold. Without the external sliding threshold, the space between the external surface of the vehicle and the edge of the platform may be larger than one or more regulations. For example, this gap may be greater than three inches (e.g., or seven and a half centimeters). The external sliding threshold reduces or eliminates this gap such that any space between the external sliding threshold and the platform edge is no greater than three inches (e.g., no greater than seven and a half centimeters).

A gap 20 may be present between the internal and external sliding thresholds. This gap may be wide enough to allow for a door panel (e.g., an external skin of the door panel) to be inserted between the internal and external sliding thresholds when the door closes. For example, the gap may be one inch or two and a half centimeters wide.

Figure 5:
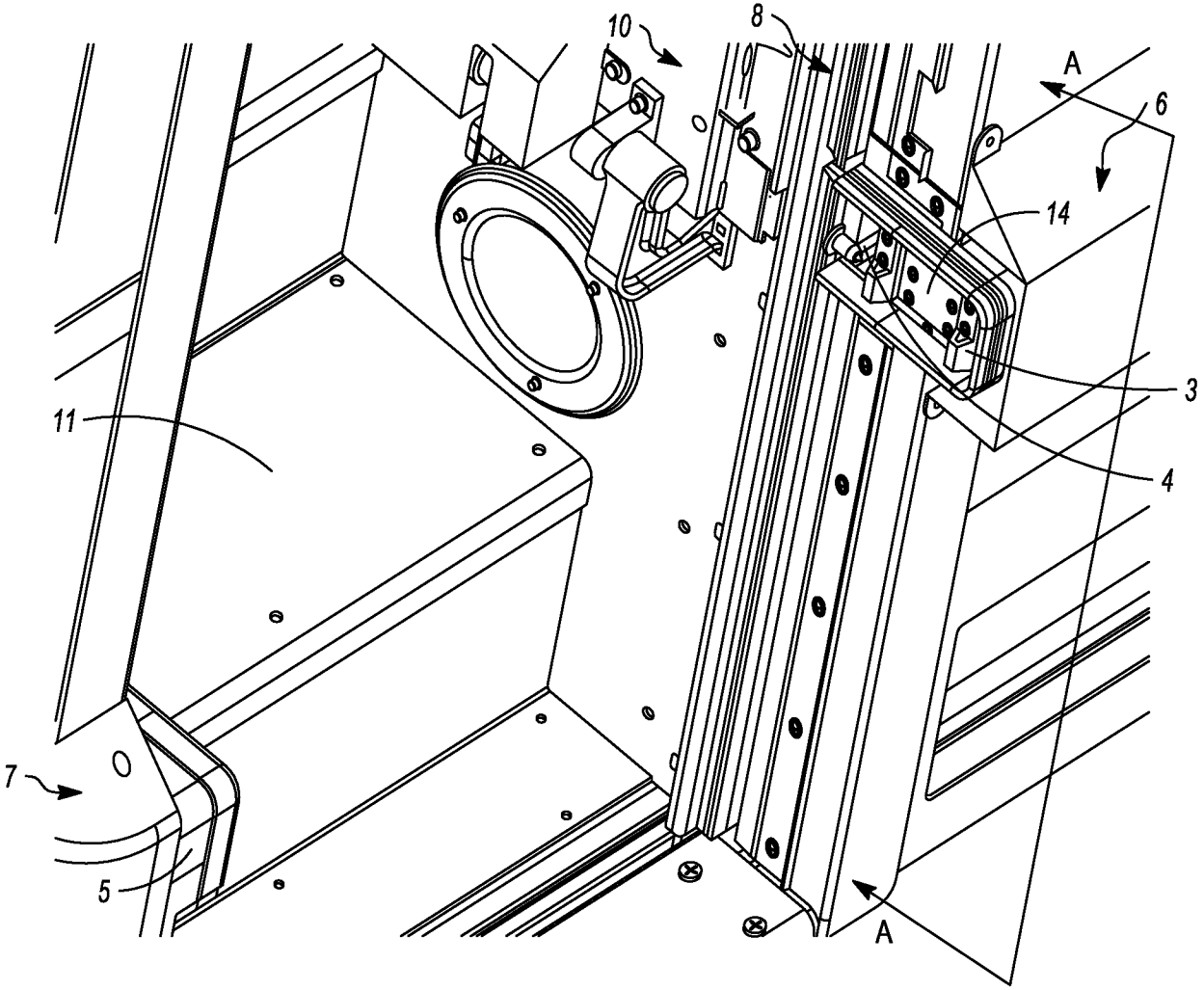
FIG. 5 illustrates the vehicle doorway threshold assembly in in the low boarding configuration or lower platform configuration with the vehicle door open.
Figure 6:
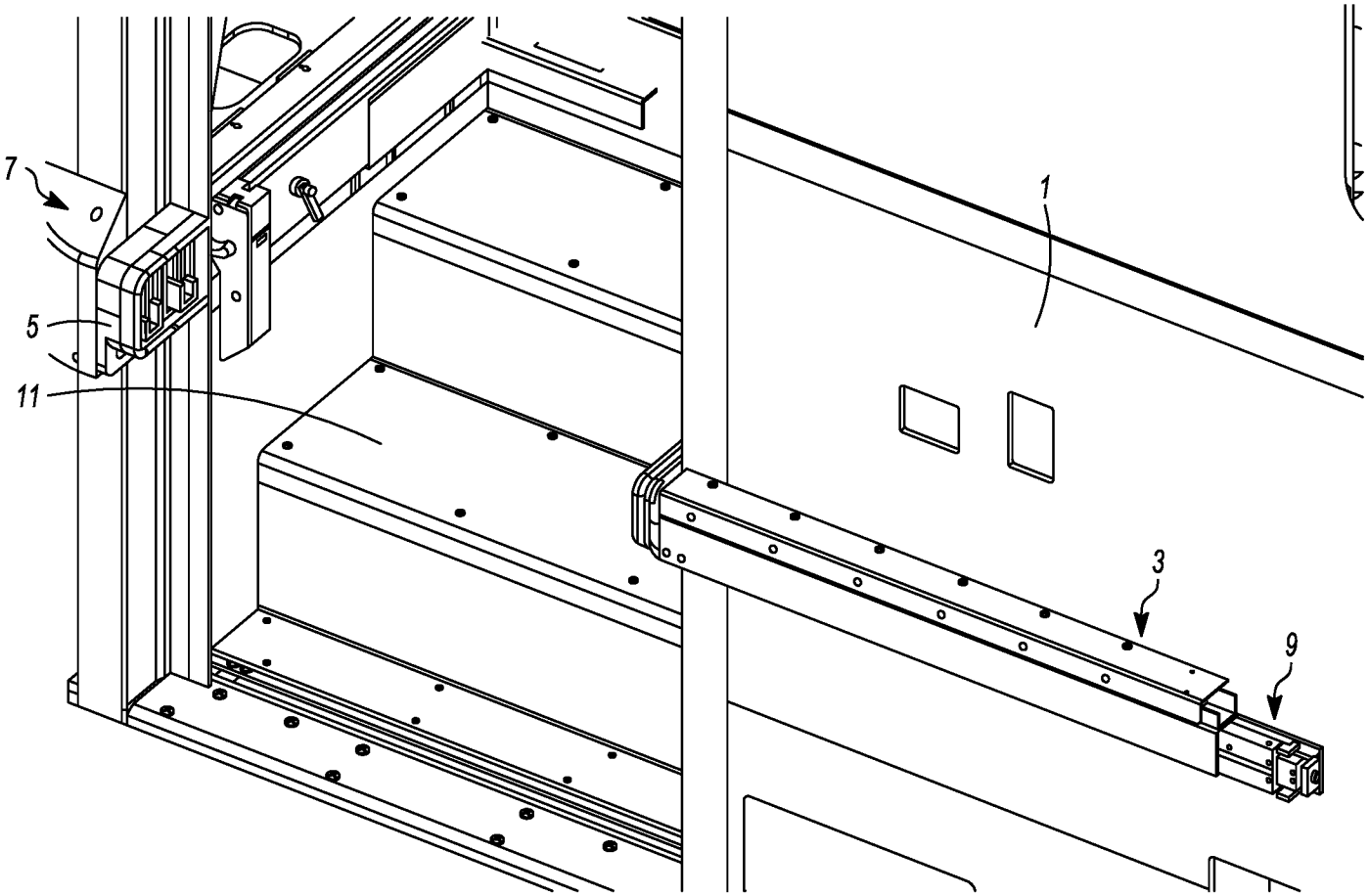
FIG. 6 also shows the door opened in low boarding configuration as in FIG. 5 from another viewing angle.

FIG. 5 illustrates the vehicle doorway threshold assembly in in the low boarding configuration or lower platform configuration with the vehicle door open. FIG. 6 also shows the door opened in low boarding configuration as in FIG. 5 from another viewing angle. In this configuration, the trap door is up or otherwise no longer disposed above the lower steps inside the vehicle. Additionally, both the internal and external sliding thresholds are retracted to clear a path up the stairs for passengers to board or alight the vehicle.

A coupling plate 14 is disposed at the outer ends of the internal and external sliding thresholds. The internal and external sliding thresholds may be cantilevered beams that are coupled with the vehicle at one end but that also have free outer ends that are not fixed to the vehicle. The free outer ends of the sliding thresholds are connected with each other by the coupling plate. This coupling plate causes the external and internal sliding thresholds to move together. For example, when the internal sliding threshold is controlled to move (e.g., by telescoping inward or outward due to action of motors, manual action, or the like), the coupling plate causes movement of the internal sliding threshold to also move the external sliding threshold. As a result, the external sliding threshold may not require an additional driver (e.g., a motor or manual action) to move the external sliding threshold between retracted and extended positions.

Figure 7:
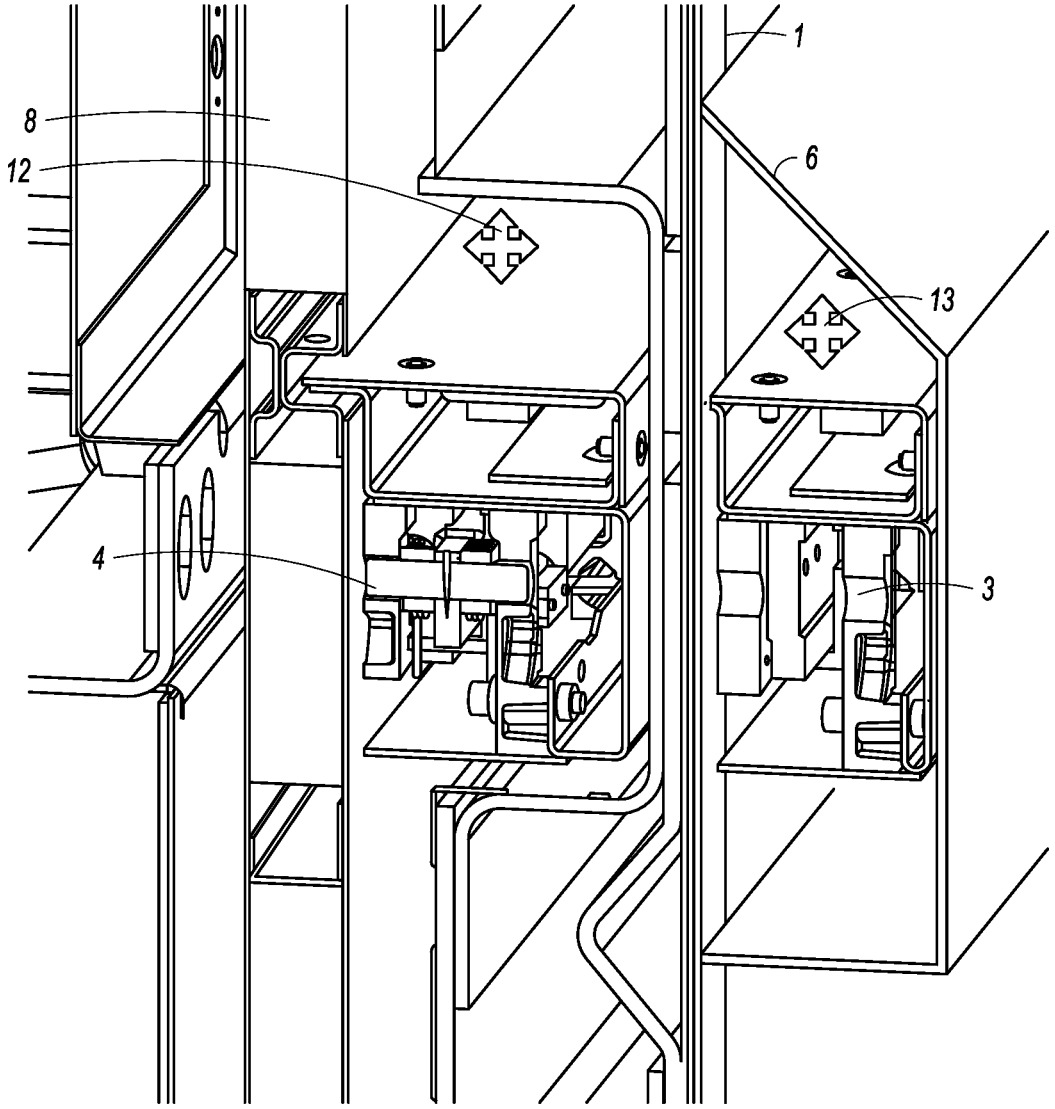
FIG. 7 is a cross-sectional view of the assembly along a plane A-A as shown in FIG. 5.

FIG. 7 is a cross-sectional view of the assembly along a plane A-A as shown in FIG. 5. As shown, the vehicle includes an internal sliding threshold pocket 12 disposed on the inside of the exterior wall of the vehicle. This pocket can be formed by a bulge in the external skin of the door panel. The internal sliding threshold can retract within this pocket when in the low boarding state or configuration. The cover on the outside of the vehicle forms an external sliding threshold pocket 13 that is bounded or delimited by the cover and the exterior wall of the vehicle. The external sliding threshold can retract within this pocket when in the low boarding state or configuration.

Figure 8:
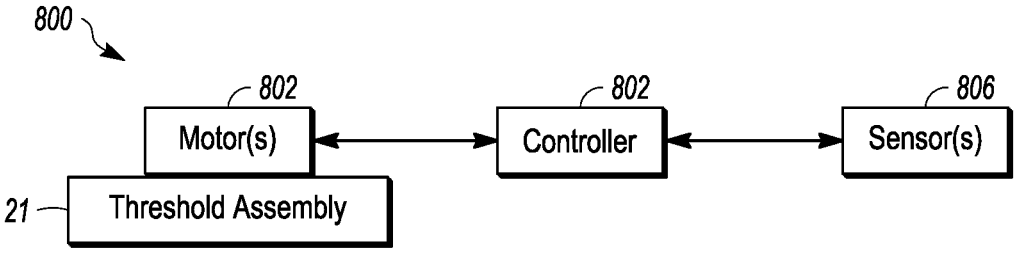
FIG. 8 shows an actuator system for the vehicle doorway threshold assembly.

FIG. 8 shows an actuator system 800 for the vehicle doorway threshold assembly. The actuator system can be used to automatically control one or more embodiments of the threshold assemblies described herein. The actuator system may move the internal threshold and/or the external threshold between the extended and retracted positions described herein. The actuator system includes a controller 802 that represents hardware circuitry that includes and/or is connected with one or more processors (e.g., microprocessors, field programmable gate arrays, integrated circuits, etc.) that perform operations of the controller as described herein.

The actuator system includes one or more motors 804 that are coupled with the internal threshold and/or external threshold. The controller can send control signals to the motor(s) activate the motor(s), deactivate the motor(s), and/or direct the motor(s) to operate in an extended direction or a retracted direction. For example, the motors may be connected with the internal and/or external threshold and, responsive to receiving an extending control signal from the controller, the motors may operate to move the internal threshold and/or external threshold to an extended position or state (shown in FIGS. 1 through 4). In response to receiving a retracting control signal from the controller, the motors may operate to move the internal threshold and/or external threshold to a retracted position or state (shown in FIGS. 5 through 7).

The controller may generate these control signals responsive to input received from an operator (e.g., by actuating one or more buttons, levers, switches, cables, etc.). Optionally, the controller may generate these control signals responsive to receiving sensor output. The actuator system may include one or more door sensors 806 that sense or detect one or more conditions of the door, the threshold assembly, and/or the exterior of the vehicle. These sensors can represent one or more of a contact sensor that generates signals indicative of whether the door has contacted another surface (e.g., indicating the door is closed) or has not contacted another surface (e.g., indicating that the door is open), a radar, radio frequency (RF) sensor, LiDAR sensor, camera, other light sensor, etc., that senses the position of the door, or another sensor. Optionally, the sensors can detect the location of the platform outside of the vehicle relative to the vehicle. For example, the sensors can include a radar sensor, an RF sensor, a LiDAR sensor, a camera, a light sensor, or the like, which determines whether the platform is an elevated or higher platform, or a lowered or lower platform. The sensor(s) can send signals to the controller of the actuator system, and the controller can determine whether the door is open or closed, and/or whether the platform is a higher or lower platform, based on the signals received from the sensor(s). The controller can then control operation of the motors to move the internal and/or external thresholds. For example, the controller can direct the motors to move the internal and/or external threshold to the extended position or state responsive to the sensor signals indicating that (a) the internal and/or external threshold is currently in the retracted position or state and (b) the platform is a higher or elevated platform. The controller can direct the motors to move the internal and/or external threshold to the retracted position or state responsive to the sensor signals indicating that (a) the internal and/or external threshold is currently in the extended position or state and (b) the platform is a lower platform.

In one embodiment, an assembly is provided that includes an external sliding threshold that may be coupled with an exterior surface of a vehicle having a doorway. The external sliding threshold may extend over the doorway to provide a threshold surface on which one or more passengers enter the vehicle via the doorway or exit the vehicle via the doorway. The external sliding threshold laterally projects from the exterior surface of the vehicle to reduce or eliminate a spatial gap between the vehicle and a platform from which the one or more passengers enter the vehicle or onto which the one or more passengers exit the vehicle.

The external sliding threshold may slide from a retracted state where the external sliding threshold does not extend over the doorway to an extended state where the external sliding threshold extends over the doorway. The assembly also may include a linear telescopic slide coupled with the exterior surface of the vehicle and with the external sliding threshold. The linear telescopic slide may move the external sliding threshold from a retracted state where the external sliding threshold does not extend over the doorway to an extended state where the external sliding threshold extends over the doorway.

The assembly may include a locking block configured to be coupled to the exterior surface of the vehicle on one side of the doorway with the external sliding threshold coupled with an opposite side of the doorway. The locking block may engage and secure the external sliding threshold in an extended position of the external sliding threshold across the doorway. The locking block may be secured to a door post of the vehicle and to transfer at least some of a load of one or more passengers stepping onto the external sliding threshold to a body of the vehicle. The locking block can include an angled or curved leading surface.

The assembly also may include a coupling plate coupled with the external sliding threshold that may concurrently couple with an internal sliding threshold that moves across the doorway with the external sliding threshold. The external sliding threshold can be a cantilevered beam having a free outer end that is coupled with the coupling plate. The assembly may include a cover that may be coupled with the exterior surface of the vehicle in a position that encloses at least part of the external sliding threshold while the external sliding threshold is in a retracted position. The external sliding threshold may not extend across the doorway while the external sliding threshold is in the retracted position. The cover can include one or more drain holes (through which moisture, condensation, etc., can drain from inside the cover).

In one embodiment, a vehicle includes a doorway through which one or more passengers board or alight the vehicle, and a threshold assembly coupled with the vehicle. The threshold assembly includes an internal threshold located across the doorway frame of the vehicle and an external threshold located outside the vehicle. The internal threshold may move along an interior of the vehicle while the external threshold moves along an exterior wall of the vehicle to an extended position where the internal threshold and the external threshold extend across the doorway to provide a threshold surface on which the one or more passengers enter the vehicle via the doorway or exit the vehicle via the doorway.

The vehicle or assembly may include a linear telescopic slide coupled with an exterior surface of the vehicle and with the external threshold. The linear telescopic slide may move the external threshold from a retracted state where the external threshold does not extend across the doorway to an extended state where the external threshold extends across the doorway. The vehicle or assembly may include a locking block configured to be coupled to an exterior surface of the vehicle on one side of the doorway with the external threshold coupled with an opposite side of the doorway. The locking block may engage and secure the external threshold in an extended position of the external threshold across the doorway. The locking block may be secured to a door post of the vehicle and to transfer at least some of a load of the one or more passengers stepping onto the external threshold to a body of the vehicle. The locking block can include an angled or curved leading surface.

The vehicle or assembly may include a coupling plate coupled with the external threshold and that may concurrently couple with an internal sliding threshold that moves across the doorway with the external threshold. The vehicle or assembly may include a cover that may be coupled with an external surface of the vehicle in a position that encloses at least part of the external threshold while the external threshold is in a retracted position.

In one embodiment, an assembly includes an external sliding threshold that may be coupled with an exterior surface of a vehicle having a doorway, and a linear telescopic slide coupled with the exterior surface of the vehicle and with the external sliding threshold. The linear telescopic slide may move the external sliding threshold from a retracted state where the external sliding threshold does not laterally extend across the doorway to an extended state where the external sliding threshold extends across the doorway. The external sliding threshold may provide a threshold surface on which one or more passengers enter the vehicle via the doorway or exit the vehicle via the doorway in the extended state.

The assembly may include a locking block coupled to the exterior surface of the vehicle on one side of the doorway with the external sliding threshold coupled with an opposite side of the doorway. The locking block may engage and secure the external sliding threshold in an extended position of the external sliding threshold across the doorway. The assembly may include a coupling plate coupled with the external sliding threshold and that may concurrently couple with an internal sliding threshold that moves across the doorway with the external sliding threshold.

In one embodiment, a vehicle is provided that includes a doorway through which one or more passengers board or alight the vehicle, an actuator system, and a threshold assembly operably coupled to the actuator system and the doorway. The threshold assembly includes an internal threshold located across the doorway of the vehicle and an external threshold located outside the vehicle. The internal threshold may slidably move along an interior of the vehicle while the external threshold slidably moves along an exterior wall of the vehicle from a retracted position where the internal threshold and the external threshold do not extend across the doorway to an extended position where the internal threshold and the external threshold extend across the doorway to provide a threshold surface on which the one or more passengers enter the vehicle via the doorway or exit the vehicle via the doorway. The actuator system may controllably move the internal threshold and the external threshold between the extended and retracted positions. The actuator system can include one or more motors and one or more processors (e.g., a door system controller) that control operation of the motor(s). The controller can control operation of the motors to move the internal and/or external thresholds. The controller can receive information (e.g., a signal from a door sensor) about the vehicle position/operational conditions, such as a door open or door closed indication, a high boarding configuration or a low boarding configuration, etc. Optionally, this signal can be obtained from input from an operator of the vehicle or actuator system. The controller can concurrently or sequentially open the vehicle doors and extend the internal and/or external thresholds responsive to receiving a signal indicating a door open condition and a high boarding configuration.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. An assembly comprising:

an external sliding threshold configured to be coupled with an exterior wall of a vehicle having a sliding door panel and a doorway, the external sliding threshold configured to extend over the doorway to provide a threshold surface on which one or more passengers enter the vehicle via the doorway or exit the vehicle via the doorway, the external sliding threshold laterally projecting from the exterior wall of the vehicle to reduce or eliminate a spatial gap between the vehicle and a platform from which the one or more passengers enter the vehicle or onto which the one or more passengers exit the vehicle, the external sliding threshold coupled with an internal sliding threshold, the external sliding threshold and the internal sliding threshold on opposite sides of the sliding door panel, the external sliding threshold coupled with the internal sliding threshold so that movement of the internal sliding threshold inside the vehicle drives the external sliding threshold outside the vehicle between an extended state and a retracted state.

2. The assembly of claim 1, wherein the external sliding threshold does not extend over the doorway in the retracted state and extends over the doorway in the extended state.

3. The assembly of claim 1, wherein the external sliding threshold is a cantilevered beam having a free outer end.

4. The assembly of claim 3, further comprising:

the internal sliding threshold, wherein the free outer end of the external sliding threshold is a first free outer end and the internal sliding threshold includes a second free outer end; and a locking block configured to be coupled to the exterior wall of the vehicle on one side of the doorway with the external sliding threshold coupled with an opposite side of the doorway, the locking block configured to receive the free outer end of the external sliding threshold in the extended state of the external sliding threshold across the doorway.

5. The assembly of claim 4, wherein the locking block is secured to a door post of the vehicle and transfers at least some of a load of one or more passengers stepping onto the external sliding threshold to a body of the vehicle.

6. The assembly of claim 5, wherein the free outer end of the external sliding threshold is a first free outer end, and the locking block also is configured to receive a second free outer end of the internal sliding threshold.

7. The assembly of claim 1, further comprising:

a coupling plate coupled with a first free open end of the external sliding threshold and configured to concurrently couple with a second free open end of the internal sliding threshold that moves across the doorway with the external sliding threshold.

8. The assembly of claim 7, further comprising the internal sliding threshold, wherein each of the external sliding threshold and the internal sliding threshold is a cantilevered beam.

9. The assembly of claim 1, further comprising a cover configured to be coupled with the exterior wall of the vehicle other than the sliding door panel in a position that encloses at least part of the external sliding threshold while the external sliding threshold is in the retracted state.

10. The assembly of claim 9, wherein the cover includes one or more drain holes.

11. The assembly of claim 1, further comprising:

an internal sliding threshold pocket disposed on an interior side of the exterior wall of the vehicle, wherein the internal sliding threshold retracts within the internal sliding threshold pocket.

12. A vehicle comprising:

a sliding door panel configured to move to open or close a vehicle doorway through which one or more passengers board or alight the vehicle; and a threshold assembly coupled with the vehicle, the threshold assembly including an external threshold located outside an exterior wall of the vehicle and an internal threshold located inside the exterior wall of the vehicle so that the external threshold and the internal threshold are on opposite sides of the sliding door panel, the internal threshold configured to move along an interior of the vehicle and drive movement of the external threshold outside of the vehicle along the exterior wall of the vehicle to an extended position where the internal threshold and the external threshold extend across the doorway to provide a threshold surface on which the one or more passengers enter the vehicle via the doorway or exit the vehicle via the doorway.

13. The vehicle of claim 12, further comprising a linear telescopic slide coupled with the exterior wall of the vehicle and with the external threshold, the linear telescopic slide configured to move the external threshold from a retracted position where the external threshold does not extend across the doorway to the extended position where the external threshold extends across the doorway.

14. The vehicle of claim 12, further comprising:

a locking block configured to be coupled to the vehicle on one side of the doorway with the external threshold coupled with an opposite side of the doorway, the locking block configured to engage and secure a free open end of each of the external threshold and the internal threshold in the extended position of the external threshold across the doorway.

15. The vehicle of claim 14, wherein the locking block is configured to be secured to a door post of the vehicle and to transfer at least some of a load of the one or more passengers stepping onto the external threshold to a body of the vehicle.

16. The vehicle of claim 15, wherein the locking block includes an angled or curved leading surface.

17. The vehicle of claim 12, further comprising:

a coupling plate coupled with a free open end of each of the internal threshold and the external threshold, the coupling plate configured to concurrently couple with the internal threshold that moves across the doorway with the external threshold to drive movement of the external threshold between the extended position and a retracted position.

18. The assembly of claim 12, further comprising a cover configured to be coupled with the exterior wall of the vehicle outside of the sliding door panel and in a position that encloses at least part of the external threshold while the external threshold is in a retracted position.

19. An assembly comprising:

an external sliding threshold configured to be coupled with an exterior surface wall of a vehicle having a sliding door panel that moves to open or close a doorway, the external sliding threshold coupled with the exterior wall of the vehicle outside of the sliding door panel, the external sliding threshold having a first free outer end;

an internal sliding threshold having a second free outer end, the internal sliding threshold and the external sliding threshold disposed on opposite sides of the sliding door panel; and a coupling plate connected with the first free outer end of the external sliding threshold and the second free outer end of the internal sliding threshold to drive the external sliding threshold from a retracted state where the external sliding threshold does not laterally extend across the doorway to an extended state where the external sliding threshold extends across the doorway, the coupling plate driving the external sliding threshold by movement of the internal sliding threshold, the external sliding threshold configured to provide a threshold surface on which one or more passengers enter the vehicle via the doorway or exit the vehicle via the doorway in the extended state.

20. The assembly of claim 19, further comprising:

a locking block configured to be coupled to the exterior wall of the vehicle on one side of the doorway with the external sliding threshold coupled with an opposite side of the doorway, the locking block configured to engage and secure the first free outer end of the external sliding threshold and the second free outer end of the internal sliding threshold in the extended state.

* * * * *